US006082501A

United States Patent [19]

Lehmann

[11] Patent Number: 6,082,501

[45] Date of Patent: Jul. 4, 2000

[54] QUICK ASSEMBLY ELEVATOR CAB

[75] Inventor: Nicholas J. Lehmann, Horn Lake, Miss.

[73] Assignee: Thyssen Elevator Holding Corporation, Troy, Mich.

[21] Appl. No.: 09/189,948

[22] Filed: Nov. 12, 1998

[51] Int. Cl.[7] ..... B66B 11/02

[52] U.S. Cl. ..... 187/401; 52/591.1; 52/592.1; 52/284

[58] Field of Search ..... 187/401; 52/591.1, 52/592.1, 284, 270

[56] References Cited

U.S. PATENT DOCUMENTS

| | | | |
|---|---|---|---|
| 1,925,417 | 9/1933 | Swank | 52/284 |
| 4,635,756 | 1/1987 | Sherwood et al. | 187/401 |
| 4,699,251 | 10/1987 | Orndoff et al. | 187/401 |
| 4,984,406 | 1/1991 | Friesen | 52/284 X |
| 5,404,686 | 4/1995 | Esposito | 52/592.1 X |
| 5,433,047 | 7/1995 | Wallace et al. | 52/284 |
| 5,842,545 | 12/1998 | Blaiotta | 187/401 |

FOREIGN PATENT DOCUMENTS

| | | | |
|---|---|---|---|
| 002591679 | 6/1987 | France | 187/401 |
| 002626864 | 8/1989 | France | 187/401 |

*Primary Examiner*—Robert P. Olszewski
*Assistant Examiner*—Steven B. McAllister
*Attorney, Agent, or Firm*—White & Case LLP

[57] ABSTRACT

An elevator cab is formed of a plurality of adjacent panels. The adjoining ends of the panels are locked together by a J-shaped latch member on one panel, and a hook member on the other panel. The J-shaped members include a first leg portion extending rearwardly from the forward wall of the panel, and a second leg portion extending at least generally parallel to the forward wall towards the opposite end of the panel. The hook shaped end includes first and second hook portions designed to abut the first and second leg portions of the J-shaped latch members, and a third hook portion extending from the second hook portion at an acute angle relative thereto. With the aforesaid structure, the panels may be assembled from inside said cab, with the J-shaped members and hook shaped members of adjacent panels forming an interlocking joint.

3 Claims, 8 Drawing Sheets

QUICK ASSEMBLY ELEVATOR CAB

FIELD OF INVENTION

The present invention relates to elevators, and in particular to an elevator cab.

BACKGROUND OF THE INVENTION

A conventional steel shell elevator cab is formed with metal sidewalls, a front return panel for housing floor select buttons and various electronics, one or more moveable doors, a strike jamb, headers, a car top, and a rear wall (or rear doors, if specified). The cab is supported on a platform supported by the car frame.

The cab is typically constructed of a series of metal panels. FIG. 13 shows a pair of illustrative panels 10 and 12. Each panel has a pair of "J" bends 14, 16, which are provided along the panel's opposed vertical edges. The "J" bends each include a series of vertical holes. In order to assemble the cab, the holes in one panel are aligned with the holes in an adjacent panel, and the panels 10, 12 are bolted together, e.g., by bolts 18.

In order to avoid having the "J" bends 14, 16 and bolts 18 visible from inside the cab, it is necessary to orient the panels 10, 12 such that these parts face the exterior of the cab. This requires the cab to be assembled from the outside. However, because the cab must normally be assembled on-site, inside the elevator shaft, requiring the cab to be assembled from the outside is often difficult and time consuming. This is true particularly when installing small elevators, where the hoistway clearances tend to be tight.

SUMMARY OF THE INVENTION

An elevator cab according to the present invention is formed of a plurality of adjacent panels, the adjoining ends of which are locked together by a J-shaped latch member on one panel and a hook shaped member on the other panel.

The J-shaped latch members include a first leg portion extending rearwardly from the forward wall of the panel, and a second leg portion extending at least generally parallel to the forward wall towards the opposite end of the panel. The hook shaped member includes first and second hook portions designed to abut the first and second leg portions of the adjacent panel, and a third hook portion extending from the second hook portion at an acute angle relative thereto, back towards the first hook portion. With the aforesaid structure, the panels may be assembled from inside said cab, by sequentially maneuvering the J-shaped member of one panel into locking engagement with the hook shaped member of an adjacent panel. Preferably, the panels include floor brackets, which are secured to the car platform after each panel has been maneuvered into place.

In the case of adjoining panels which are intended to be coplanar, such as the panels forming the sidewalls and rear wall, the first hook portion extends rearwardly, at right angles to the forward wall. In the case of adjoining panels which are meant to be at right angles to one another, e.g., in the rear comers of the cab, the first hook portion extends parallel to the forward wall.

For a better understanding of the invention, reference is made to the following detailed description of a preferred embodiment, taken in conjunction with the drawings accompanying the application.

DETAILED DESCRIPTION OF PREFERRED EMBODIMENTS

An elevator according to the invention includes a car platform 20 and an elevator cab 22. The platform 20 may be supported in any suitable manner, such as by a sling or a hydraulic cylinder, to be raised and lowered between floors.

Figure 1:
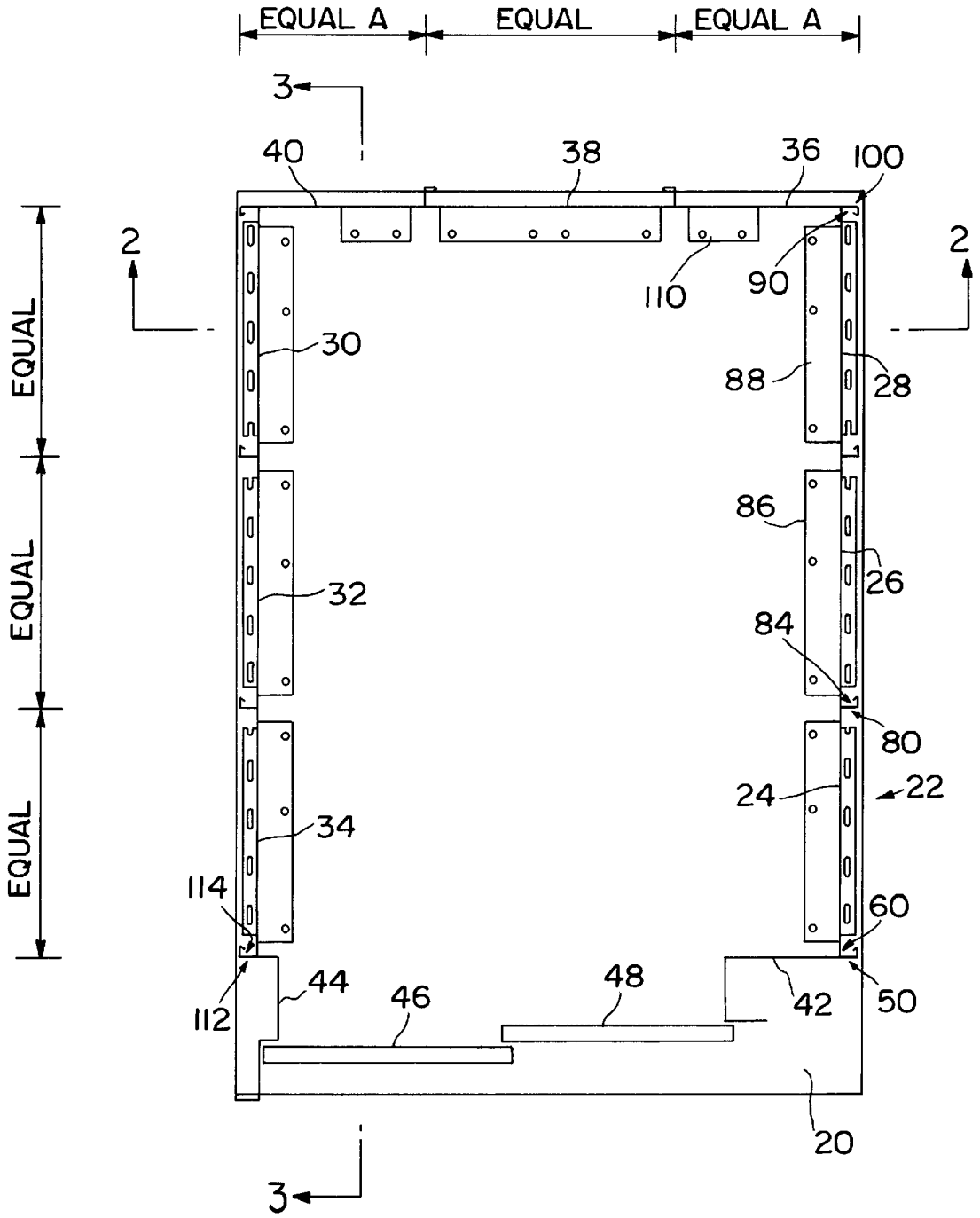
FIG. 1 is a top, sectional view of a car according to the invention.
Figure 2:
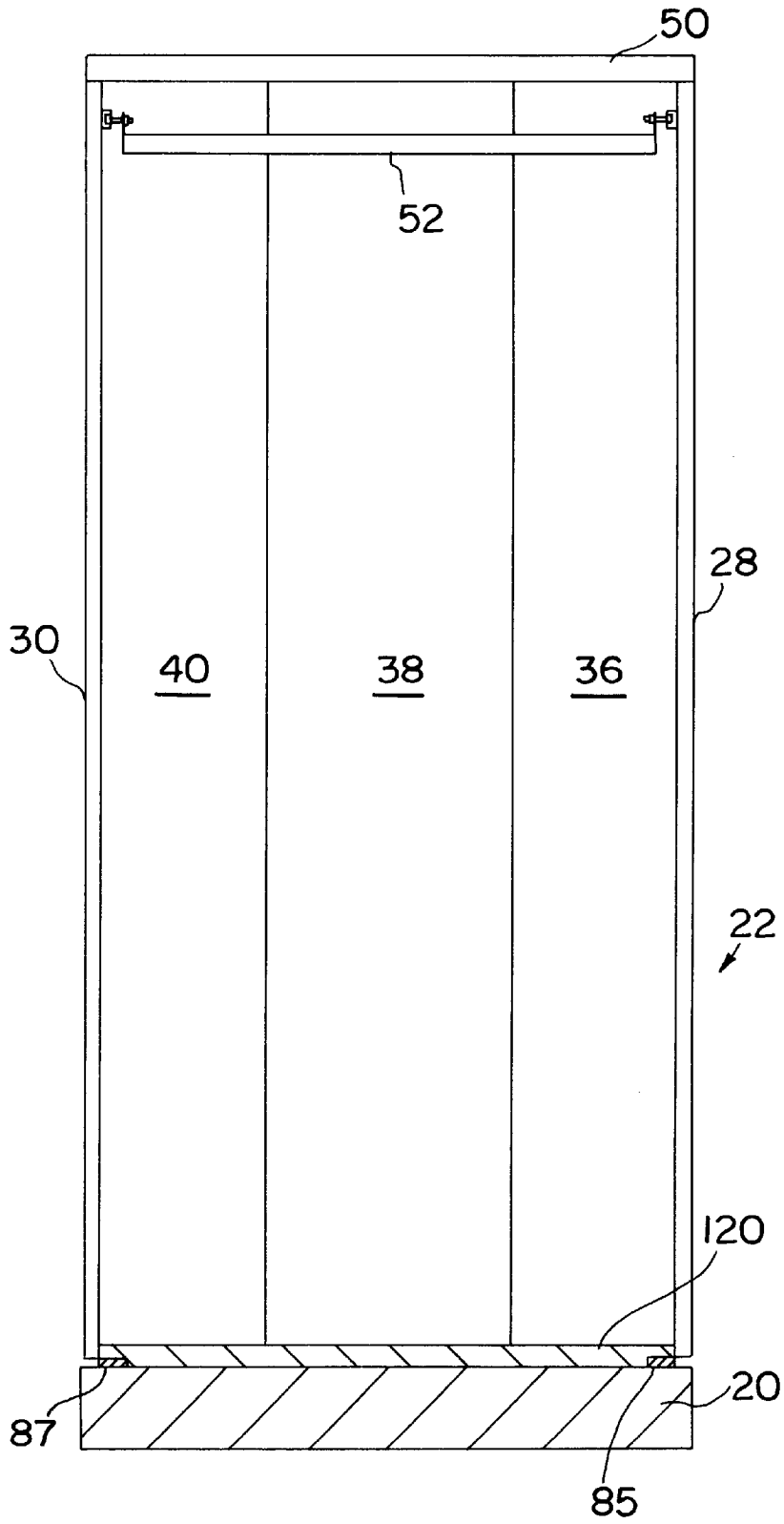
FIG. 2 is a front, sectional view of the car, taken in the direction of arrows 2—2 of FIG. 1.
Figure 3:
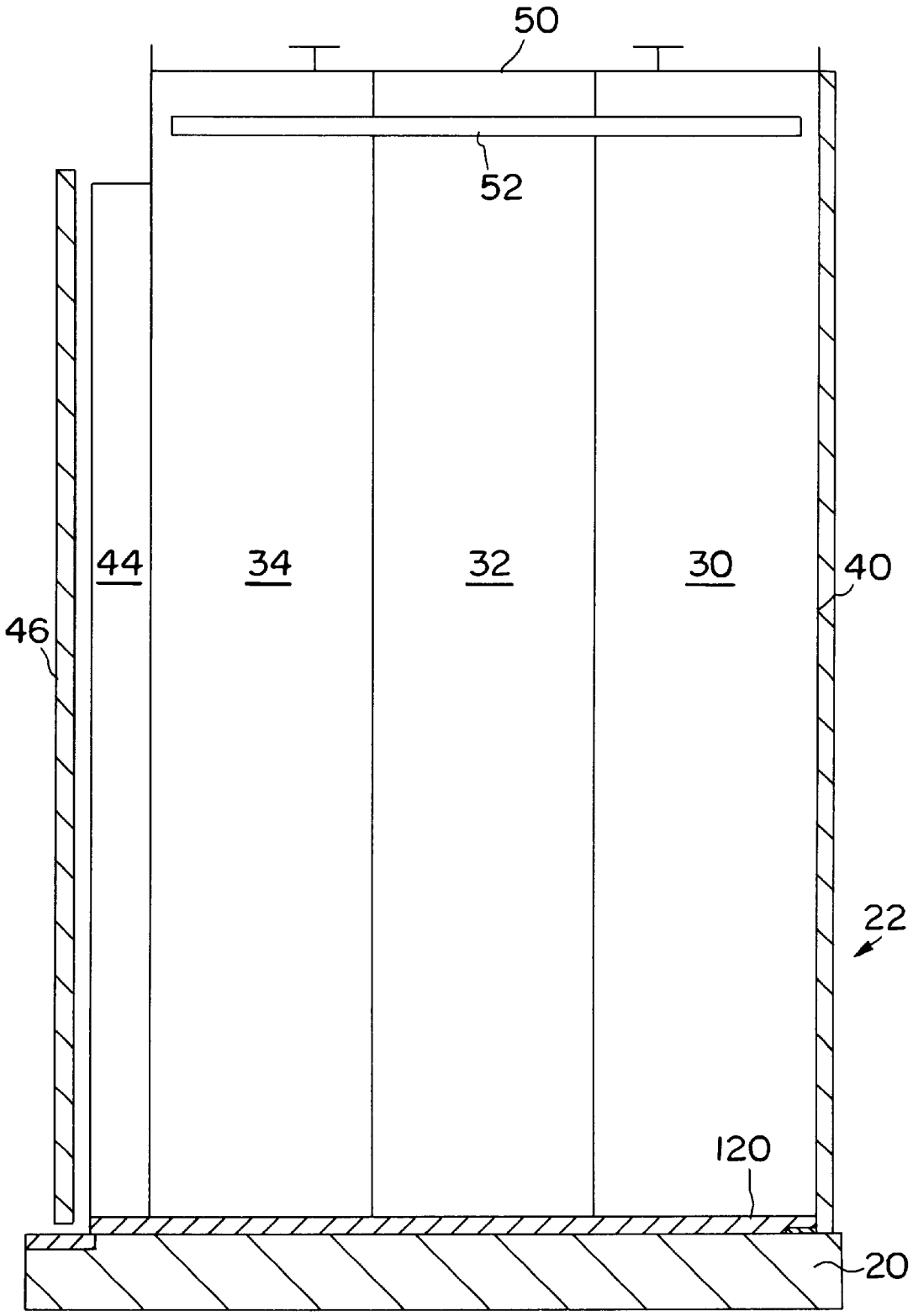
FIG. 3 is a side, sectional view, taken in the direction of arrows 3—3 of FIG. 1.

As shown in FIGS. 1–3, the elevator cab 22 includes a pair of opposed sidewalls. One sidewall is formed by metal panels 24, 26, 28, and the opposite sidewall is formed by metal panels 30, 32, and 34. A rear wall is formed by panels 36, 38, and 40. The cab 22 also includes a strike panel 44, a return panel 42, a pair of side-opening doors 46, 48, a cab top 50, and a drop ceiling 52.

Figure 4:
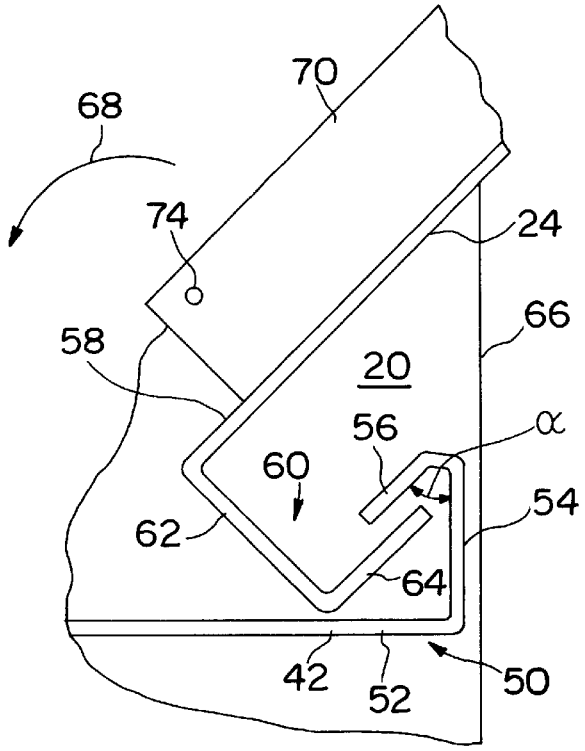
FIGS. 4 and 5 are top views of portions of a return panel and the adjoining side panel, shown during and after their assembly process.
Figure 5:
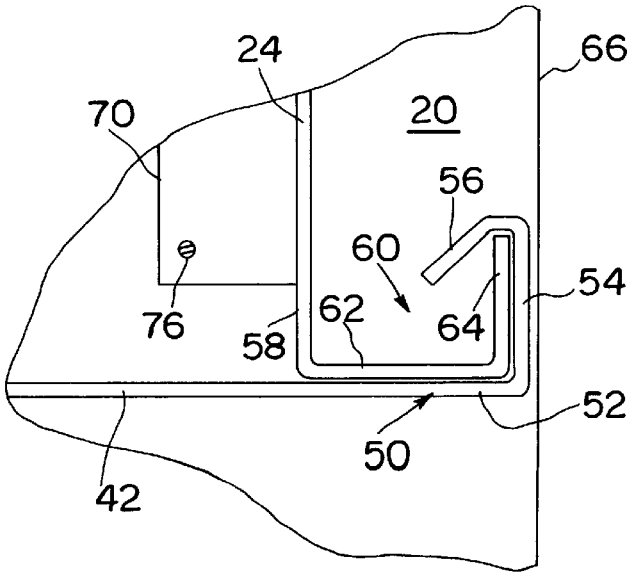

An example of a cab assembly will now be described, starting with the return panel. Referring to FIGS. 1 and 4–5, the end of the return panel 42 includes a hook member 50 which extends along the panel's vertical edge. The hook member 50 is formed by a first hook portion 52, and a second hook portion 54, the two hook portions 52, 54 being at right angles to one another, and a third hook portion 56. The third hook portion 56 extends from the second hook portion 54 back towards the first hook portion 52, at an acute angle $\alpha$ relative to the second hook portion 54. In the exemplary embodiment, the hook portions 52, 54, 56 are integral with the return panel wall and are formed by bending the end wall portion of the return panel 42. As shown by FIG. 4, the hook portions 52, 54, 56 form a vertically oriented channel.

The first side panel 24 includes a forward wall 58 and a vertically oriented, J-shaped latch member 60. The J-shaped latch member is formed by a first leg portion 62 which extends rearwardly from the forward wall 58, at right angles thereto, and a second leg portion 64 which extends at least generally parallel to the forward wall 58 towards the opposite end of the panel 24. As in the case of the hook portions, the leg portions 62, 64 are integral with the panel wall 58 and formed by bending the end wall portion of the panel 24.

As shown in FIG. 4, in order to begin the assembly of the cab, the return panel 42 is secured to the platform 20, in any known manner, so that the second hook portion 54 is parallel to the side edge 66 of the platform 20 (i.e., so that the opening of the hook channel faces away from the platform edge 66). The J-shaped latch member 60 of the first side panel 24 is then maneuvered so that the second leg portion 62 is inserted behind the third hook portion 56, and the side panel 24 is then rotated, in the direction of arrow 68, into the position shown in FIG. 5.

As shown in FIG. 5, once the side panel 24 is rotated into place, the first and second leg portions 62, 64 of the J-shaped member 60 abut the first and second hook portions 52, 54 of the hook member 50, and are locked in place by the third hook portion 56. Preferably, the side panel 24 includes a floor bracket 70 which projects from the bottom edge of the panel 24. The bracket include holes 74 so that, once the panel 24 has been rotated into its desired position, the bracket 70 may be screwed or bolted to the platform 20, e.g., with screws 76.

Angle $\alpha$ is chosen to be large enough so as to allow the J-shaped end to be maneuvered into the hook end within the space limitations available in the elevator shaft, but maintained small enough so that the hook joint will lock the adjoining panel securely in place. In the exemplary embodiment, angle $\alpha$ is about 75°.

Figure 6:
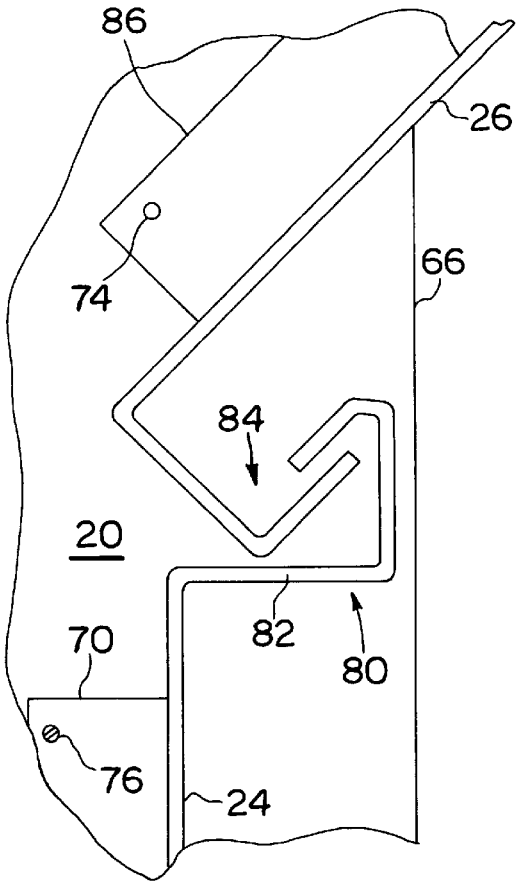
FIGS. 6 and 7 are top views of the opposite end of the side panel shown in FIGS. 4–5 and of a portion of the next, adjoining side panel during and after their assembly process.
Figure 7:
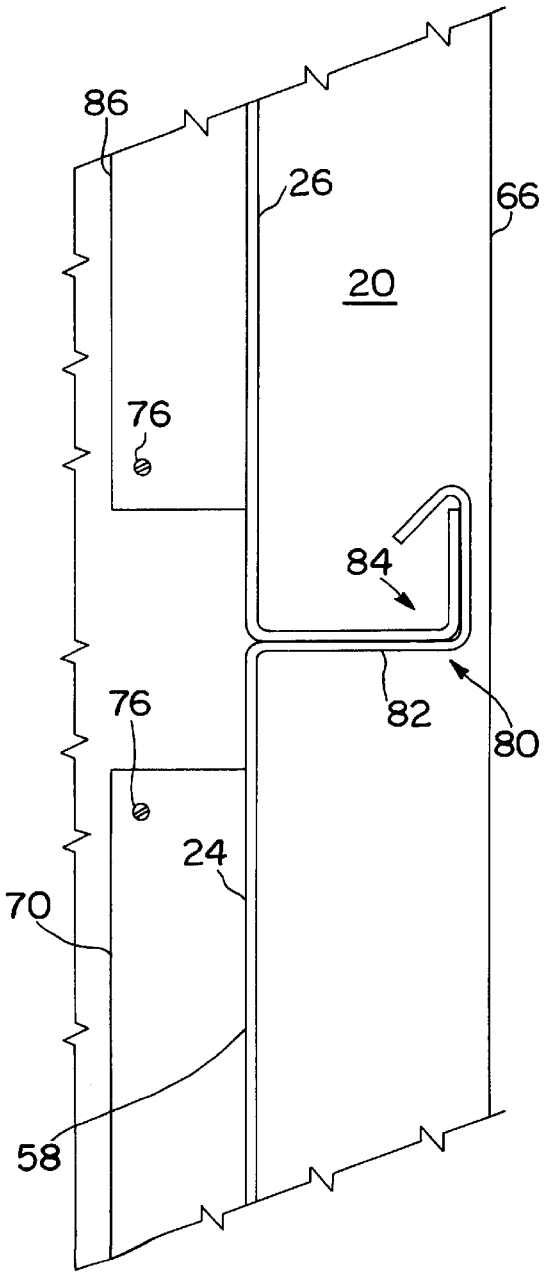

As shown in FIGS. 1 and 6–7, the opposite end of the first side panel 24 includes a hooked shape member 80. The hooked shaped member 80 is similar to the hook shaped member 50 of return panel 42, except that the first hook portion 82 extends perpendicular to the forward face 58 rather than being coextensive with it. The adjoining end of the next side panel 26 includes a J-shaped member 84 which is identical with the J-shaped member 60. As shown in FIGS. 6–7, the side panel 26 is maneuvered into position in exactly the same manner as the first side panel 24, so that the J-shaped member 84 of the second side panel 26 interlocks with the hook shaped member 80 of the panel 24. Once in place, screws 76 may be inserted into the screw holes 74 of the floor bracket 86 of the second side panel 26 to lock it in position.

Referring to FIG. 1, the opposite end of the second side panel 26 includes a hook shaped member which is identical with the hook shaped member 80, and the third side panel 28 includes a J-shaped member which is identical with the J-shaped members 60 and 84. The third side panel is maneuvered into place in the same manner as the first and second panels, and its floor bracket 88 is then screwed or bolted to the platform 20.

Figure 8:
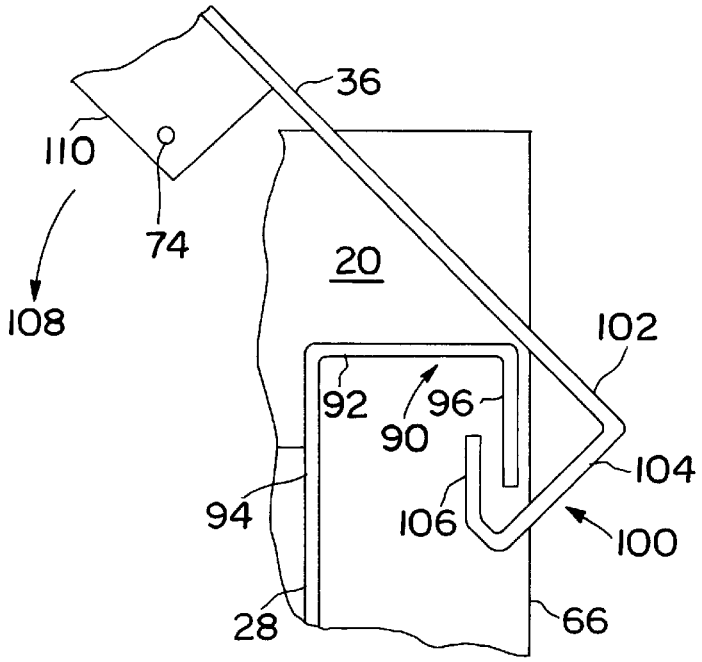
FIGS. 8 and 9 are top views of the right rear corner of the cab, showing portions of the adjoining side and rear panels during and after their assembly process.
Figure 9:
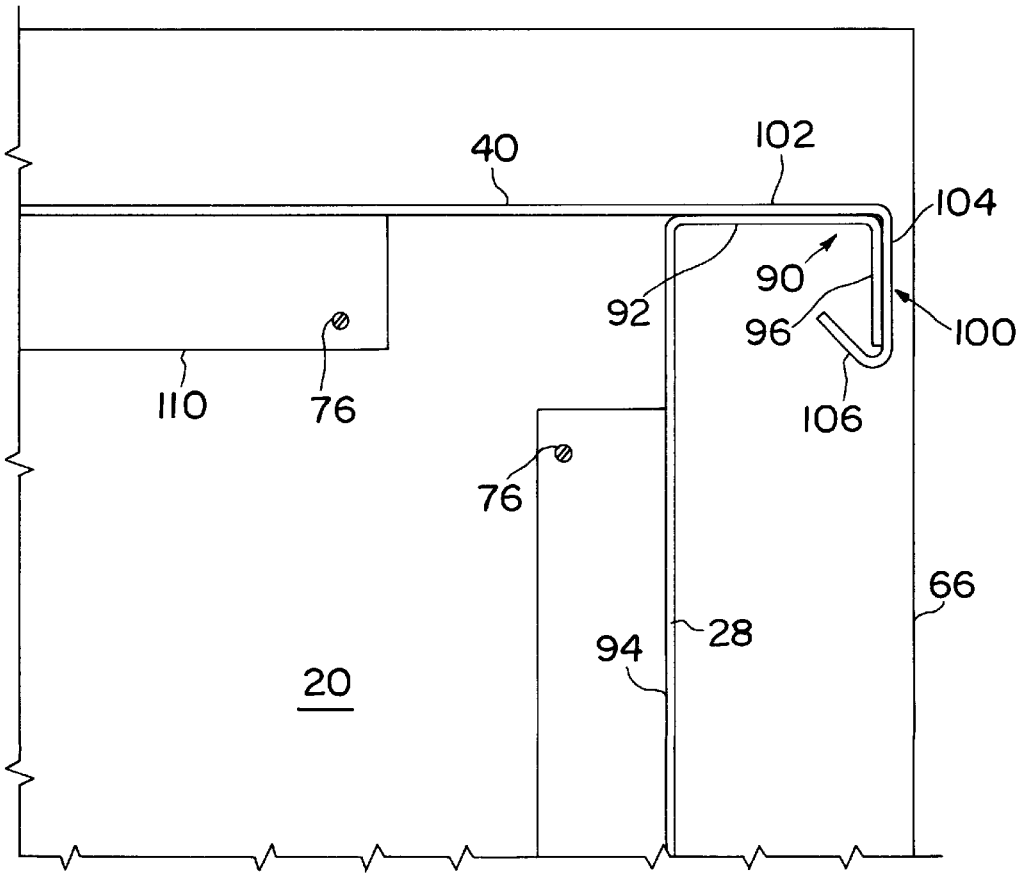

As shown in FIGS. 1 and 8–9, the opposite end of the third side panel 28 includes another J-shaped member 90, which is a mirror image of the J-shaped members 60 and 84. Thus, the J-shaped member includes a first leg portion 92 which extends rearwardly from the forward face 94 of the panel 28, and a second leg portion 96 which extends at right angles to the first leg portion 92, parallel to the forward face 94, toward the forward end of the panel 28.

The right, rear panel 36 includes a hook member 100 formed by a first hook portion 102, which is an extension of the rear panel 36, a second hook portion 104, which extends perpendicular to the first hook portion 102, and a third hook portion 106 which extends from the second hook portion 104 towards the first hook portion 102 at an acute angle relative to the second hook portion 104. As shown in FIG. 8, the right rear panel 36 is maneuvered so that the third hook portion 106 of the hook member 100 catches behind the second leg member 96 of the J-shaped member of the side panel 28, and the rear panel 36 is then rotated, in the direction of arrow 108, into the position shown in FIG. 9. In such position, the first and second hook portions 102, 104 of the hook portion 100 abut the first and second leg portions 92, 96 of the J-shaped member 90, such that the two members form a locking joint. The floor bracket 110 is then screwed or bolted to the platform 20 to lock the rear panel 36 in place.

The opposite side of the cab is assembled in a similar manner. Referring to FIG. 1, the strike panel 44 is first secured to the platform 20 in a known manner. The strike panel 44 includes a hook member 112 at its rearward end, which is a mirror image of the hook member 50 of the return panel 42. The side panels 34, 32 and 30 are mirror images of the side panels 24, 26, and 28. Thus, the side panel 34 includes a J-shaped member 114, which assembles into and interlocks with the hook member 112 in the same manner as the J-shaped member 60 interlocks with the hook member 50. Once it is rotated into place, the side panel 34 is screwed or bolted to the platform 20, and the remaining side panels 32, 30 are sequentially assembled in the same manner as panels 26 and 28.

Figure 10:
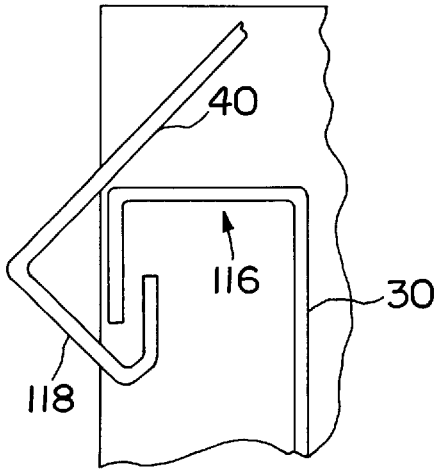
FIG. 10 is a top view of the left rear corner of the cab, showing adjoining side and rear panels during their assembly process.

As shown in FIG. 10, the rearmost side panel 30 includes a forward facing J-shaped member 116, and the left rear panel 40 includes a hook member 118. The J-shaped member 116 and hook member 118 are mirror images of the J-shaped member 90 and hook shaped member 100 at the right rear comer of the cab and, as shown in FIG. 10 the assembly process is a mirror image of the assembly between side panel 28 and right rear panel 36.

Referring again to FIG. 1, the facing ends of the right and left rear panels 36, 40 include hook members. The hook member on rear panel 36 is identical with the hook member 80 on panel 22, whereas the hook member on the left rear panel 40 is a mirror image thereof The center rear panel 38 has a J-shaped member at either end. In the exemplary embodiment shown, the center rear panel 38 is assembled after the side panels 42, 24, 26, 28, 44, 34, 32, and 30 and the left and right rear panels 36, 40 have been installed. In order to install the center rear panel 38, it is raised atop the rear panels 36, 40 and lowered so that the J-shaped members slide into the channels formed by each of the facing hook members on the panels 36, 40. Once all of the panels have been screwed or bolted to the platform 20, a finished floor 120 is laid down, covering the floor brackets 70, 85, 88, etc.

As shown in FIGS. 6 and 7, when the first hook portion 82 is oriented perpendicular to the forward wall 58 of a panel, the adjoining panel will be coplanar. As shown by FIGS. 4–5 and 8–10, when the first hook portion is coplanar with the forward wall of the panel, the adjoining panel will be oriented at right angles.

Referring to FIGS. 2 and 3, a car top 50 is preferably secured to the upper ends of all the panels. The top 50, which is preferably formed of a plurality of panels, may be secured in any suitable manner, such as by providing out turned formed legs (not shown) at the top of the side and rear panels. The cab top panels are maneuvered so as to rest on top of the out turned legs, and then bolted to the legs. This allows the top to be assembled from inside the car. However, other methods may be used to secure the top to the panels.

Figure 11:
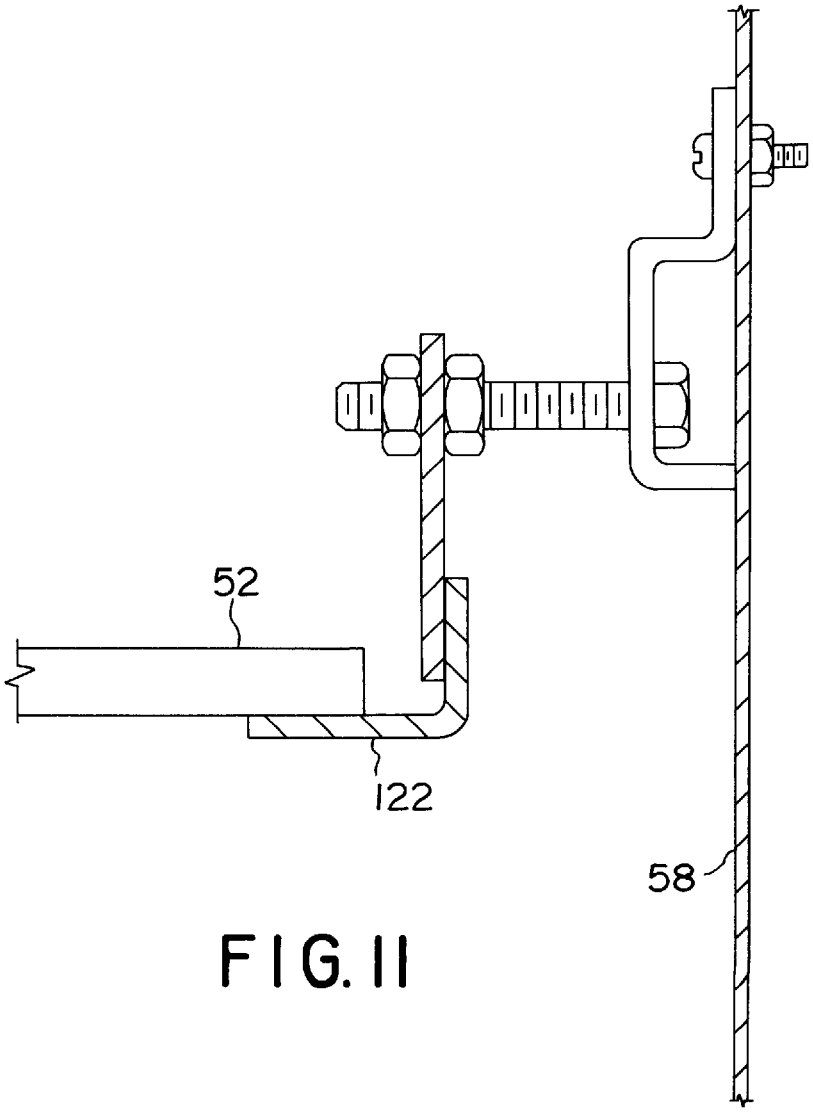
FIG. 11 is front view, partially in section, of a mechanism supporting a drop ceiling.

In addition to the car top 50, a dropped ceiling 52 may be provided. As shown in FIG. 11, the dropped ceiling 52 may be mounted on formed brackets 122 attached to the cab walls 58. The dropped ceiling preferably includes a plurality of panel elements, and the brackets 122 are attached only to the side panels 24, 26, 28, 30, 32, and 34, and not to the rear panels 36, 38, 40.

Figure 12:
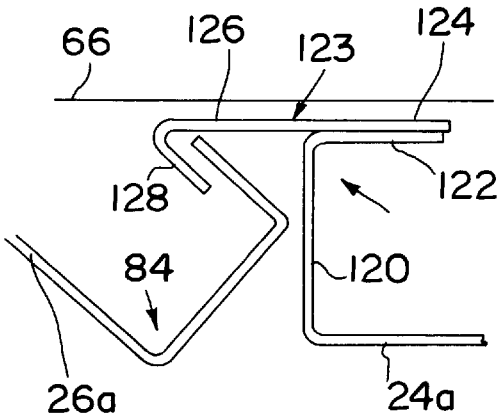
FIGS. 12 and 12*a* are top views, similar to FIGS. 6 and 7, of an alternative embodiment.
Figure 12A:
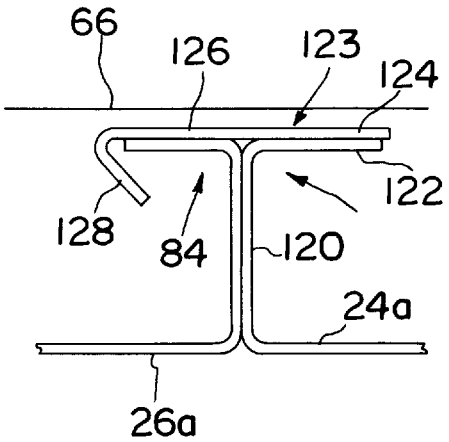
Figure 13:
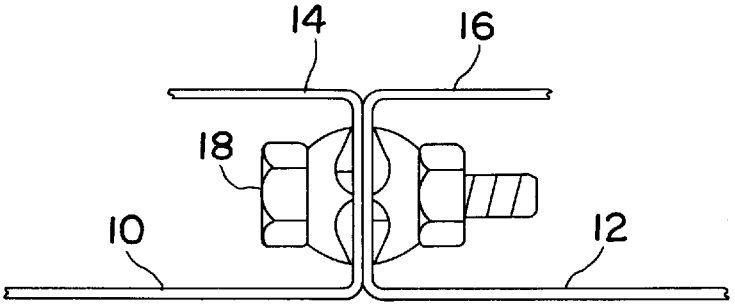
FIG.13 PRIOR ART
FIG. 13 is a top view of a portion of two adjoining conventional elevator car panels, showing a prior art attachment mechanism.

FIGS. 12 and 12*a* show an alternative embodiment of a hook joint. The J-shaped member 84 of panel 26*a* is the same as the J-shaped members in the first embodiment. In the case of the hook shaped member 80*a,* however, rather than forming the hook member integral with the panel, the end of the panel 24*a* is formed into a J-shaped member defining a first hook portion 120 and an extension portion 122 which extends perpendicular thereto. A hooked extension piece 123 includes a support portion 124, which is welded to the extension portion 122, a second hook portion 126, which extends perpendicular to the first hook portion 120, and a third hook portion 128 which extends at an acute angle from the distal end of the second hook portion 126. This embodiment is functionally the same as the first embodiment, but offers the advantage of being easier to fabricate.

As can be appreciated from the foregoing discussion, the walls of the cab can be assembled completely from inside of the cab. The hook and J-shaped joints are not visible from the cab's interior, thus producing an attractive appearance. Also, although the floor brackets are visible during assembly, they are covered over by the finished floor 112 and thus will not be visible when the elevator goes into service. Similarly, any hardware securing the car top 50 to the panels would not be visible due to the drop ceiling.

The invention allows for the use of modular panels. Thus, the side panels (except for the left and right rearmost side panels) and the center rear panel may all be of the same width. To construct cabs of different sizes, only the rear side and rear corner panels would need to be customized. Alternatively, the rear comer panels may be of a fixed size, in which case the center rear panel and rear side panels would be customized for each application.

The foregoing represents preferred embodiments of the invention. Variations and modifications will be apparent to persons skilled in the art, without departing from the inventive concepts disclosed herein. For example, while the panels are preferably metal, they may be made of other materials such as reinforced plastics or wood. Further, while the hook and J-shaped members are shown as being made of the same materials as the panel walls, it would be possible to make the panel walls of one material, such as wood, and to attach separate hook and J-shaped members made, e.g., of metal. All such modifications and variations are intended to be within the skill of the art, as defined in the following claims.

I claim:

1. A method of constructing an elevator cab in an elevator having a car platform with front, rear, and opposed side edges, comprising the steps of:

(a) providing a plurality of panels, each panel having a wall and opposite vertical ends;

(b) providing a hook shaped member along one vertical end of a first said panel, wherein said hook shaped member includes a first hook portion extending rearwardly from said wall, perpendicular thereto, a second hook portion extending away from the opposite vertical end, generally perpendicular to the first hook portion, and a third hook portion extending from said second hook portion towards said first hook portion and lying at an acute angle relative to said second hook portion, wherein said third hook portion has a distal end spaced from said first hook portion to form a vertical opening;

(c) positioning said first said panel on said platform along one side edge, so that said vertical opening at least generally faces the opposite side edge of said platform, and securing said first panel relative to said platform;

(d) providing a second panel having a J-shaped latch member along one vertical end, wherein said J-shaped latch member includes a first leg portion extending rearwardly from the wall of the second panel, perpendicular thereto, and a second leg portion extending at least generally parallel to the wall towards the opposite vertical end of said panel;

(e) pivoting the second panel about a vertical axis so as to be oriented at an angle relative to said one side edge;

(f) inserting the second leg portion of the J-shaped member of said second panel into the hook shaped member of said first panel, and pivoting the second panel about a vertical axis so that said first and second panels are coplanar and so as to form an interlocking joint between said first and second panels in which said first and second leg portions abut said first and second hook portions, respectively, and said third hook portion prevents separation between adjoining panels in a horizontal direction;

(g) securing said second panel relative to said platform, whereby said first and second panels are be assembled from inside the car; and (h) providing a back wall panel provided with a second hook shaped member on one end, wherein the hook shaped member includes a first hook portion coplanar with the back wall panel and extending away from the opposite end, a second hook portion extending at a right angle to said first hook portion, and a third hook portion lying at an acute angle relative to the second hook portion.

2. A method according to claim 1, comprising the step of providing a hook member along the opposite vertical end of said second panel, providing a J-shaped latch member along a vertical end of a third panel, joining said second and third panels as in steps (e) and (f) of claim 1, and securing said third panel relative to said platform, wherein said first, second and third panels form one side wall of said elevator cab.

3. A method according to claim 2, comprising further the steps of providing fourth, fifth, and sixth panels, wherein said fourth panel has a hook member along one vertical end, said fifth panel has a J-shaped latch member and a hook member, respectively, along its opposed vertical ends, and wherein said sixth panel has a J-shaped latch member along one vertical end, and assembling said fourth, fifth, and sixth panels along the opposite side edge of said platform, in same manner specified for the first, second, and third panels, respectively, to form an opposite side wall of said elevator cab.

* * * * *